US006122921A

United States Patent [19]

Brezoczky et al.

[11] Patent Number: 6,122,921

[45] Date of Patent: Sep. 26, 2000

[54] SHIELD TO PREVENT CRYOPUMP CHARCOAL ARRAY FROM SHEDDING DURING CRYO-REGENERATION

[75] Inventors: Thomas Brezoczky; Murali Narasimhan, both of San Jose, Calif.

[73] Assignee: Applied Materials, Inc., Santa Clara, Calif.

[21] Appl. No.: 09/233,393

[22] Filed: Jan. 19, 1999

[51] Int. Cl.[7] ..... B01D 8/00

[52] U.S. Cl. ..... 62/55.5

[58] Field of Search ..... 62/55.5

[56] References Cited

U.S. PATENT DOCUMENTS

| | | | |
|---|---|---|---|
| 3,485,054 | 12/1969 | Hogan | 62/55.5 |
| 4,121,430 | 10/1978 | Bachler et al. | 62/55.5 |
| 4,311,018 | 1/1982 | Welch | 62/55.5 |
| 4,446,702 | 5/1984 | Peterson et al. | 62/55.5 |
| 4,479,360 | 10/1984 | Bachler et al. | 62/55.5 |
| 4,514,204 | 4/1985 | Bonney et al. | 62/55.5 |
| 4,611,467 | 9/1986 | Peterson | 62/55.5 |
| 4,803,845 | 2/1989 | Strasser et al. | 62/55.5 |
| 4,815,303 | 3/1989 | Duza | 62/55.5 |
| 5,111,667 | 5/1992 | Häfner et al. | 62/55.5 |
| 5,156,007 | 10/1992 | Bartlett et al. | 62/55.5 |
| 5,301,511 | 4/1994 | Barlett et al. | 62/55.5 |
| 5,400,604 | 3/1995 | Häfner et al. | 62/55.2 |
| 5,513,499 | 5/1996 | deRijke | 62/55.5 |
| 5,517,823 | 5/1996 | Andeen et al. | 62/55.5 |
| 5,518,593 | 5/1996 | Hosokawa et al. | 204/192.12 |
| 5,658,442 | 8/1997 | Van Gogh et al. | 204/298.12 |
| 5,736,021 | 4/1998 | Ding et al. | 204/298.11 |

*Primary Examiner*—William Doerrler
*Attorney, Agent, or Firm*—Thomason, Moser & Patterson

[57] ABSTRACT

The present invention provides a regeneration shield 22 for a vacuum system, typically used in the processing of integrated circuits. The regeneration shield protects fragile arrays 13, having a dislocatable material 16, such as charcoal, in a high vacuum pump 4 from volatile regeneration gases, which impinge the fragile material on the array and dislocate that material to cause pumping inefficiencies and scrap. The shield may be planar, concave, or convex and may have sides. The shield may also have inwardly and outwardly extending flanges.

21 Claims, 6 Drawing Sheets

SHIELD TO PREVENT CRYOPUMP CHARCOAL ARRAY FROM SHEDDING DURING CRYO-REGENERATION

BACKGROUND OF THE INVENTION

1. Field of the Invention

The present invention generally relates to an apparatus and method for protecting a vacuum system. Specifically, the invention relates to an apparatus and method for shielding or containing at least a portion of dislocatable material during regeneration of a high vacuum cryogenic system.

2. Background of the Related Art

Processing systems are becoming increasingly complex, particularly in the semiconductor industry. Inordinate demands are placed upon the equipment due to the high degree of cleanliness necessary to produce commercially viable components, because even microscopic inclusions can have disastrous effects upon the integrated circuits. Significant improvements in high performance vacuum systems have been developed for maintaining this high degree of cleanliness. Even small changes in vacuum technique may be considered important inventive steps as the performance envelope is pushed even farther in the field. Reduced pressure, in the $10^{-7}$ to $10^{-9}$ base pressure range, is indicative of conditions where few molecules of gas or contaminants are present in any cubic centimeter of chamber volume.

By way of background, the flow chart of FIG. 1 describes a generic substrate processing sequence using a high performance vacuum system, and problems associated with the use or implementation thereof. A typical system includes a processing chamber, a valving system, and at least one vacuum pump. Initially, the processing chamber is open to the atmosphere and atmospheric gases are introduced into the chamber. The chamber is closed to create a fixed volume of a pressure at or below atmospheric pressure and a low vacuum pump, generally known as a "roughing pump," reduces the pressure in an initial pumping stage down to a mTorr range.

Due to the cleanliness requirements, typically a high vacuum pump is also needed to pump the chamber to a desired vacuum level of about $10^{-5}$ to $10^{-9}$ torr. One type of high vacuum pump is a cryogenic pump. Cryogenic pumps are based on the principle of removing gases from a processing chamber by binding the gases on cold surfaces inside the cryopump. In general, gases entering the pump are frozen or adsorbed on cold surfaces in the pump and therefore removed from the remaining atmosphere in the processing chamber, which lowers the chamber pressure. Cryocondensation and cryosorption are the main mechanisms involved in the operation of the cryogenic pump. In cryocondensation, gas molecules are condensed on cooled surfaces. As the molecules pass by the cold surfaces of the pump, they reduce the kinetic energy of the molecules, at which point a "sticking coefficient" becomes operative and the molecules stick to the cold surfaces. Thus, the molecules are removed from a gaseous state and less molecules remain in the atmosphere, which causes the pressure in the pump and/or chamber to decrease. However, some gases are difficult to condense at the normal operating temperatures of the cryogenic pump by cryocondensation and so cryosorption is used. For cryosorption, a sorbent material, such as activated charcoal or zeolite, is attached to the coldest surface in the cryopump. Because the binding energy between a gas particle and the adsorbing surface is greater than the binding energy between the gas particles themselves, the gas particles that cannot be condensed are removed from the vacuum system by adhering to the sorbent material. Cryogenic pumps are described in U.S. Pat. No. 5,513,499, U.S. Pat. No. 5,517,823, U.S. Pat. No. 5,111,667, and U.S. Pat. No. 5,400,604, which are incorporated herein by reference.

To prepare the cryogenic pump for operation, it is first pumped down to a starting vacuum level by a roughing pump. Typically, the cryogenic pump is open to the chamber volume, which is likewise pumped by the roughing pump to the desired level. The roughing pump may operate simultaneously or sequentially with the pumping of the chamber so that the cryogenic pump and processing chamber pressures are each lowered to a mTorr range. When the cryogenic pump has been pumped down by the roughing pump, the cryogenic pump is actuated and the temperature lowers to an operating range. If an isolation valve was used to isolate the cryogenic pump from the processing chamber in the roughing stage, it is opened to allow the cryogenic pump to continue the pumping process of the processing chamber.

Cryogenic pumps typically operate in two stages where each stage uses an array. The first stage array operates at higher temperatures, usually between about −223° C. (50° K) to −133° C. (100° K) and generally at about −208° C. (65° K), and may be used to create a vacuum in the chamber by condensing gases such as water and carbon dioxide. The first stage array is generally made of one or more plates or other surfaces and is sometimes coated to enhance its emissivity and therefore its performance. The cryogenic pump second stage operates at lower temperatures, usually below about −253° C. (20° K), and uses a second stage array of one or more cooled plates to "pump" the remaining gases such as nitrogen, oxygen, argon, and so forth. Some gases are not condensed at even that low temperature and need collecting in a cryosorption process, described above. For instance, hydrogen will not condense until about −265° C. (8° K), which exceeds the abilities of even a cryogenic pump. Thus, sorbent material, such as carbon, which collects the hydrogen may be attached to a second stage array. This sorbent material is somewhat fragile and may be dislocated by turbulent gases or liquids. As a result of these factors, a cryogenic pump is termed a "capture" pump.

When the process gases, such as precursor gases, enter the chamber, the flow eventually produces an "ice" buildup of frozen gas(es) on the array(s). As processing continues, the "ice" buildup may overlap the array(s), which begins to restrict the pump and choke its ability to perform effectively. At this point in the process, captured gases need to be released and expelled from the pump. Thus, a "regeneration cycle" is needed, where the cryogenic pump is briefly warmed until the captured gases evaporate. Warming may include deactivating the pump briefly to raise the system to a higher temperature, so that the frozen gases can be liquefied and/or gasified, removed from the pump, and operation resumed. Nitrogen is sometimes used to help purge the system during this phase, to minimize re-adsorption of the released gases on the second stage sorbent material.

As the "ice" evaporates in the regeneration cycle, the frozen gases transition to liquids, herein termed "liquefied gases", that are normally in a gaseous state at ambient conditions, but at the given temperature and/or pressure are in a liquefied state. The liquefied gases, and other gases that transition into a gaseous state, caused by the regeneration cycle are collectively termed herein "regeneration gases." The regeneration gases may flash violently, form gaseous jets in the chamber, produce high shear gaseous and liquid flows, and splash over the arrays as the frozen gases transition into liquids or further into gases. This turbulence may cause the charcoal to become mechanically dislodged or dislocated from the second stage array, thereby forming particles and impurities in the substrate processing cycle.

FIG. 2 is a partial cross sectional schematic showing the "ice" in the chamber, described above. The chamber, described in more detail below, includes an outer housing 8 in which the first stage array 6 is adjacent the housing 8. The first stage array 6 condenses the water and carbon dioxide to form a relatively thin layer of first stage array "ice" 17. The second stage array 13 includes a series of array plates generally designated as 14, with individual plates designated as 14*a*–14*f*, and is cooled with an expander module 21. Dislocatable material 16, having individual segments 16*a*–16*f* attached to the array plates 14*a*–14*f* respectively, adsorbs gases, such as hydrogen, that do not condense on the second array plates 14. As the frozen gases condense and "freeze" on the second array, "ice" layers 15*a*–15*f* form on the array plates 14*a*–14*f* respectively. The "ice" 15 may accumulate particularly on the array plates closest to the incoming gases, such as on plate 14*a*, and produce a larger accumulation of "ice" 15*a*. This accumulation restricts the gas flow to the remaining array plates and reduces the pumping capacity, at which point the above described regeneration cycle is needed. As the regeneration cycle progresses, the "ice" melts to form liquids and solids collected in the lower portion of the cryogenic pump. Some pieces of ice may fall from the array plates and float in the liquid. As the liquids and solids contact the relatively warm surfaces of the chamber during regeneration and return to a gaseous state (herein collectively termed "regeneration gases"), the liquids and solids become volatile and impinge the dislocatable material 16 with high flow rates, which are believed to act with a shear force on the dislocatable material and may dislocate portions of the material, such as dislocated portions 19*a*–19*f* of the material.

When the chamber is again brought to an operating condition, the dislocated particles of charcoal may become lodged in at least two places—neither of which are desirous and both of which are detrimental to system performance. The first place is at the various seals around the chamber, such as a pressure relief valve seal. With such a low desired pressure level, even microscopic particles can effect the ability of the seal to function properly. Any leaks in the sealing may lead to longer times to evacuate the system, a faster build up of "ice", and more frequent regeneration. Secondly, the particles may flow into the chamber. Impurities in the chamber adversely affect the integrated circuit or other products and may lead to scrap parts that may be discovered some time later after considerable additional expense has been invested into the circuitry.

Once the sealing efficiency has been adversely affected or the scrap rate reaches an unacceptable level, the processing chamber is taken off line from the production process and maintenance initiated. Typically, maintenance involves several hours of disassembly, locating the problem, cleaning, re-assembly, and pumping the system back to high vacuum, using the steps described above. The entire process may cost 10–15 hours or more of production time at a heavy monetary loss.

Thus, a need exists to avoid the dislocation of the material from the arrays and particularly the charcoal on the second array.

SUMMARY OF THE INVENTION

The present invention seeks to remedy the dislocation, or shedding, problem described above by providing a method and an apparatus having a regeneration shield between a high vacuum pump array(s) and regeneration gases formed when the high vacuum pump is regenerated. The regeneration gas(es) are typically formed when frozen gases formed in the high vacuum pump are melted and the liquid flashes to a volatile state. The regeneration shield arrangement helps prevent dislocation of the material attached to the array and especially charcoal attached to the second array of a cryogenic pump. In a preferred embodiment of the system, the invention may include a processing chamber, a vacuum pump connected to the processing chamber comprising at least one array and having an internal volume, a dislocatable material attached to the array, and a mechanical regeneration shield interposed between the array and at least a portion of the internal volume of the pump wherein the regeneration shield is adapted to shield the dislocatable material from at least a portion of the internal volume. The shield may be configured to encase a portion of the second array in a inwardly disposed manner or it may be configured to outwardly shed any liquid or solid materials in a outwardly disposed manner. In a preferred method, the invention may include at least partially evacuating a processing chamber utilizing a high vacuum pump having at least one array comprising dislocatable material, flowing process gases into the high vacuum pump, creating a restriction in the high vacuum pump, regenerating the high vacuum pump, and shielding the dislocatable material on the array from a portion of regeneration gases produced during regenerating the high vacuum pump.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention offers a method and system using an array regeneration shield for protecting dislocatable material on a high vacuum pump, particularly a second stage array in a cryogenic pump. Because the gases produced during regeneration are volatile, the dislocatable material, such as charcoal, becomes dislocated. The shield helps protect the dislocatable material from the volatile gases, so that the dislocatable material remains intact and does not materially interfere with the pumping or processing sequences.

Figure 3:
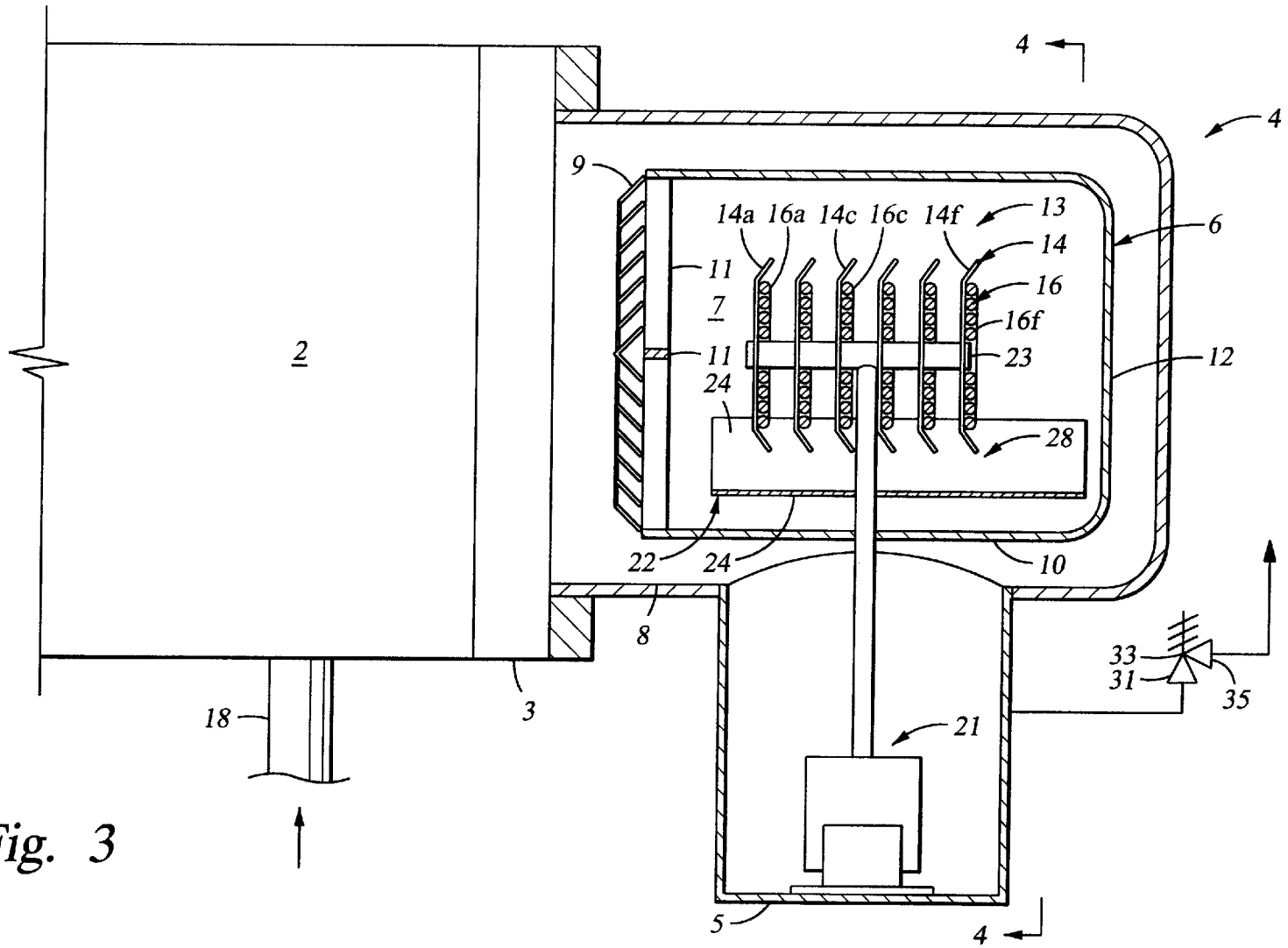
FIG. 3 is a partial schematic view showing one embodiment of the present invention having an inwardly disposed arrangement of the shield.
Figure 4:
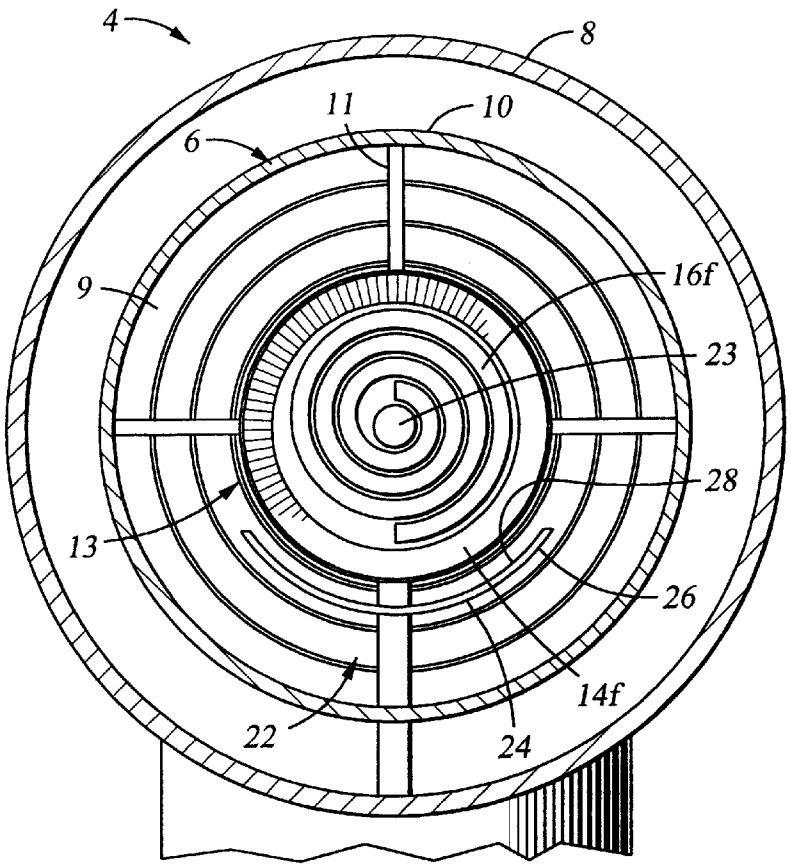
FIG. 4 is an end view cross sectional schematic of FIG. 3.
Figure 5:
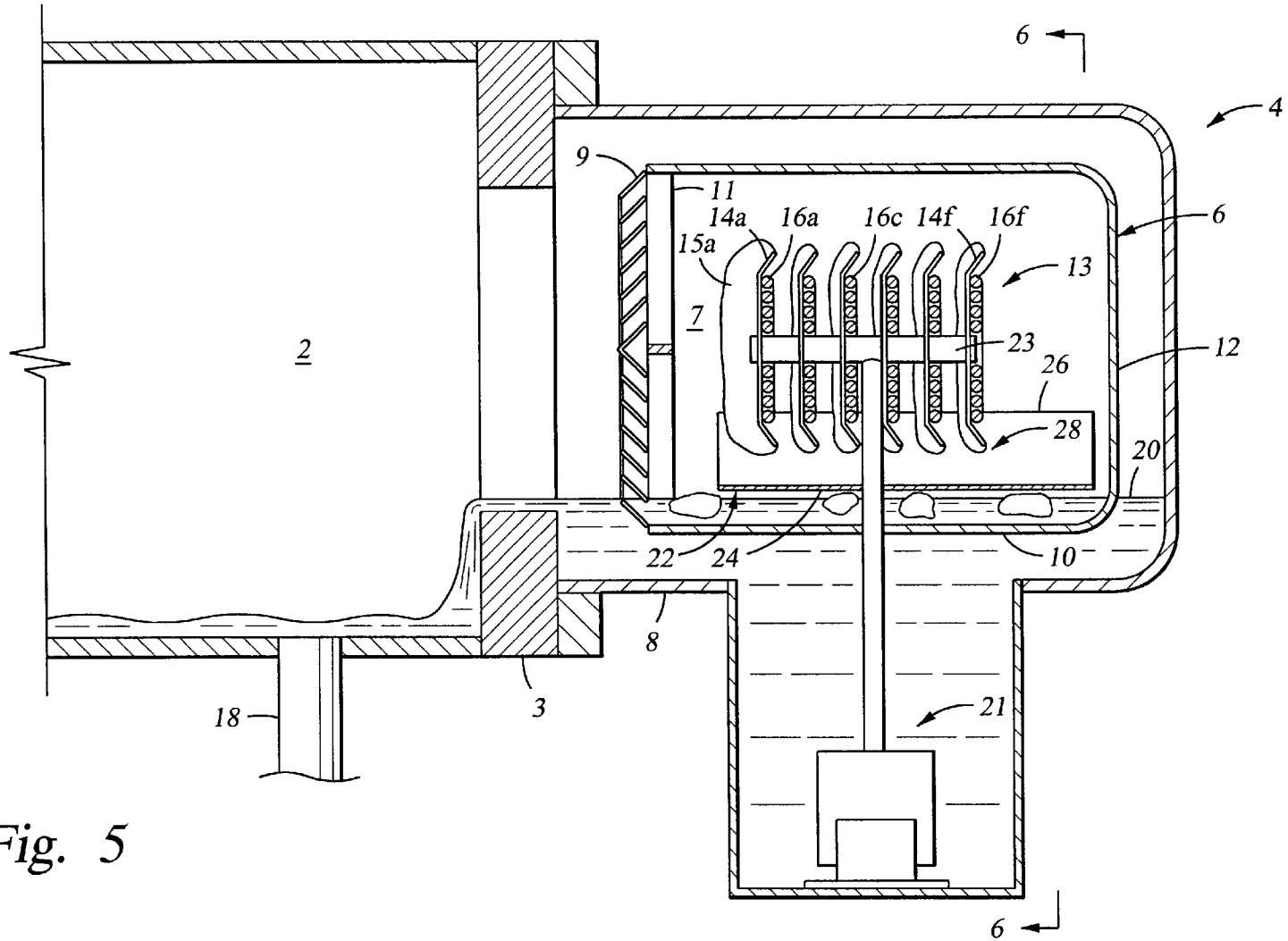
FIG. 5 is a side view schematic of FIG. 3 showing the "ice" melting and forming a layer of liquid and ice in the lower portions of the cryogenic pump.

FIGS. 3–5 are partial schematic views of one embodiment of the present invention, where FIGS. 3 and 5 are side views and FIG. 4 is an end view of the chamber having a shield. A processing chamber 2 mounts to a high vacuum pump 4 and is fluidly connected thereto at a pump inlet. An isolation valve 3, such as a throttle valve, slit valve, and other valves, is disposed between the processing chamber and the pump to allow separate control of the vacuum level of each. The processing chamber is preferably a physical vapor deposition (PVD) chamber, although a chemical vapor deposition (CVD) chamber and a variety of other processing chambers may be used. Various processing equipment (not shown) in the chamber can be present such as robotic equipment for handling the processed material, processing equipment such as plasma generators, targets, and associated equipment.

As mentioned above, the processing chamber is brought to an initial vacuum in the mTorr range by a roughing pump (not shown). When the processing chamber is ready to begin the high vacuum stage, the isolation valve 3 is opened to allow communication between the processing chamber and the high vacuum pump and, which has separately been pumped with a roughing pump to the mTorr range. The pressure in the processing chamber can vary and may be considered a high vacuum/low pressure chamber at about $10^{-5}$ Torr and less. The high vacuum pump 4 in a preferred embodiment includes a cryogenic pump, although other pumps may be similarly situated, as for example, a getter pump.

The high vacuum pump 4, preferably a cryogenic pump, includes a housing 8 which encloses, except for the first stage array opening 7 which is open to the chamber, generally two arrays for its first and second stages. The "stages" may operate simultaneously or sequentially. The first stage array 6 may vary in shape, however, a typical configuration is cylindrical. The first stage array is "kettle" shaped with a first stage array side 10, first stage array bottom 12, and a first stage array opening 7, and may include a series of annular vanes 9 to alter the gaseous flow and provide additional surface area. The annular vanes are connected to the side 10 by first stage array connectors 11, which may be one or more rods attached to the vanes with the rod ends attached to the side 10. The first stage array opening 7 faces toward the isolation valve 3 and processing chamber 2 to allow gases to enter the first and second arrays for pumping. The first stage array side 10 is a cylindrically shaped wall surrounding the first stage array bottom 12. Other shapes, sizes, and orientations are possible. The first stage array may be anodized black to aid in emissivity.

In this embodiment, the second stage array 13 is received within the envelope of the first stage array 6. The second stage array is maintained at a temperature of about −261° C. (12° K) in a steady state mode, where most gas molecules will be captured. One factor in operating a cryogenic pump is that the cooled surfaces, such as the individual plates 14*a*–14*f*, typically face the flow of the gases from the chamber to capture the molecules before the molecules are adsorbed by the sorbent material and prematurely saturate the sorbent material. The plates 14 are typically made from a conductive material, such as copper, and may be circularly shaped. An expander cavity 5 is sealably attached to the housing 8 and encloses an expander module 21 which is attached to an expander module rod 23, used to cool the second stage array. The expander module rod is typically made from nickel plated copper and is attached to each of the second stage array plates 14*a*–14*f*.

Because some gases, such as hydrogen, are not condensed by the cooled array surfaces, sorbent material, such as charcoal, is typically installed on the individual plates 14*a*–14*f*, which collects the hydrogen and other gases. Because this sorbent material is typically fragile, it may be dislocated by turbulent gases or liquids and is termed a "dislocatable material" 16 herein, with individual segments designated as 16*a*–16*f* to correspond to the plates 14*a*–14*f*. Other dislocatable sorbent materials, such as zeolite could be used.

Figure 1:
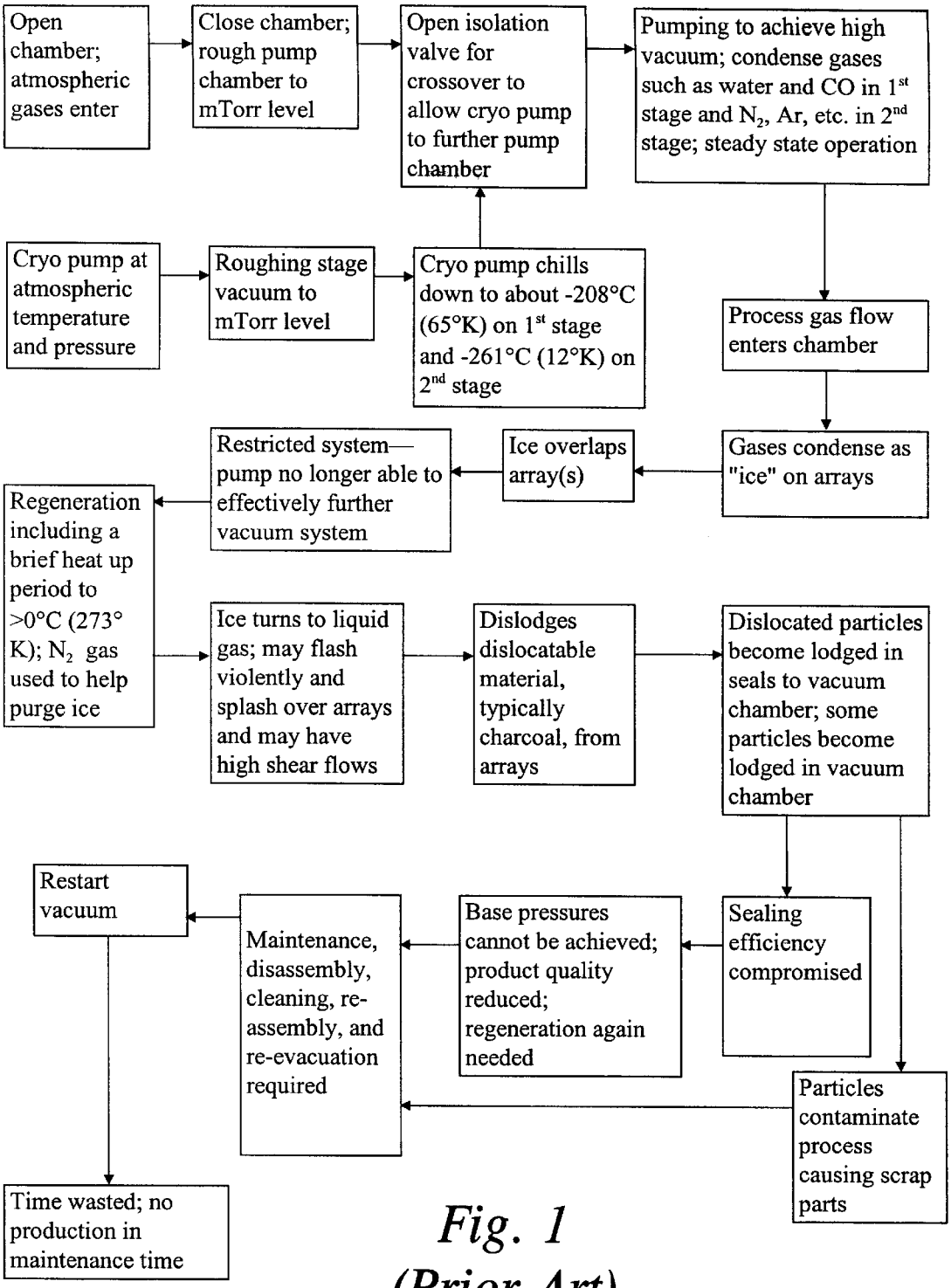
Fig. 1 (Prior Art)
FIG. 1 is a flow chart of a typical high vacuum process, including a regeneration process showing the problems of the present systems.
Figure 2:
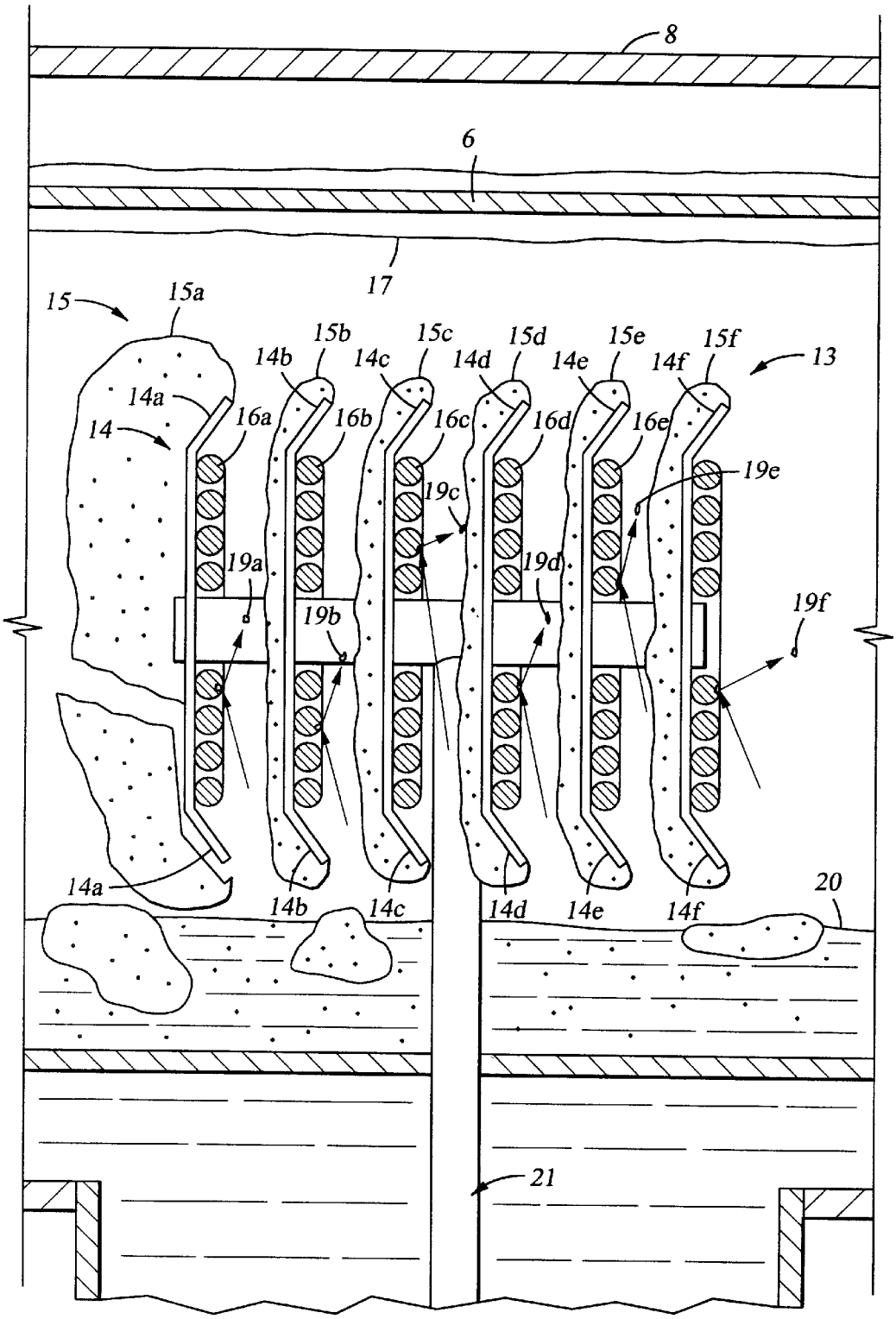
Fig. 2 (PRIOR ART)
FIG. 2 is partial schematic showing the accumulation of ice on the arrays and the "ice" flashing and dislocating material on the array during a regeneration cycle.

Once the vacuum level reaches the desired range, the processing chamber 2 is ready for substrate processing. Process gases, such as precursor gases, enter the chamber 2 through the gas inlet 18 fluidly connected to a gas source (not shown). The gas flow rates through the inlet may be about 5 to 200 sccm, although lower or higher flow rates are certainly possible. The flow rates are provided to enable processing to occur at a desired pressure, which for PVD processing may be about $10^{-3}$ torr. Some of the gases will migrate into the cryogenic pump, where the gases condense and build up on the array surfaces and restrict the flow of gases to the arrays. To restore the pumping efficiency, the above described regeneration is used. However, the flashing of the gases as an "ice" or a liquid may dislocate the fragile material on the second array, shown in FIG. 2. The dislocated material may impair the ability of a seal, such as an O-ring located at sealing point 33, that seals the relief valve poppet 35 to the relief valve 31.

To solve the problem, a regeneration shield 22 may be used, which typically will be a mechanical shield, although other types of shields, such as those involving electromagnetic fields could be used. The shield may have a shield bottom 24 which might be planar or curved inwardly, as shown in FIG. 3. The term "inwardly" is meant to include the direction that is toward the center portion of the pump and in this instance away from the bottom of the chamber and "outwardly" is meant to include the direction toward the outer surfaces or perimeter of the pump. The shield 22 may also have a shield side 26 or a plurality of sides that may assist in shielding from the regeneration gas flashing and a shield top 28 that is open to the array. In this embodiment, the shield side is inwardly disposed from the shield bottom 24. The shield material may be a metal, such as nickel plated copper, or some other appropriate material for high vacuum usage, preferably having good thermal conductivity and being relatively thin, such as approximately 0.03" or less. A surface coating may be used, such as the coating on the first stage array, having a high emissivity. The shield may be located so that at least a portion of the shield is higher than the "ice" level when melted, which may assist the shield effectiveness when the liquids flash.

FIG. 5 shows the chamber with the shield during the regeneration cycle. The ice layer 15*a* has partially melted and other portions have fallen off the second stage array. Other ice layers in the chamber have melted and a liquid level 20 has been established in the chamber, having a layer of ice and liquid. In rigorous instances, the liquid may overflow the level of the valve 3 and drain out the gas inlet 18. As the ice continues to melt, the liquid contacts the relatively warmer surfaces of the chamber, and the regeneration gases become volatile and flash, the resulting energy is dissipated by impacting the shield surfaces and is diffused throughout the pump area. Thus, the dislocatable material 16 is shielded from the flash or other high shear flows of the regeneration gases. The shield could be placed in a variety of locations and have a variety of shapes. Based on experience, the inventors believe that the above shape may be a preferred embodiment for the typical installation and configuration of a cryogenic pump. If for instance, the pump was located in a vertical plane, instead of a horizontal plane, the shield could be relocated to a more appropriate location. Also, the shield bottom 24 could be planar and could have inwardly extending sides.

Figure 6:
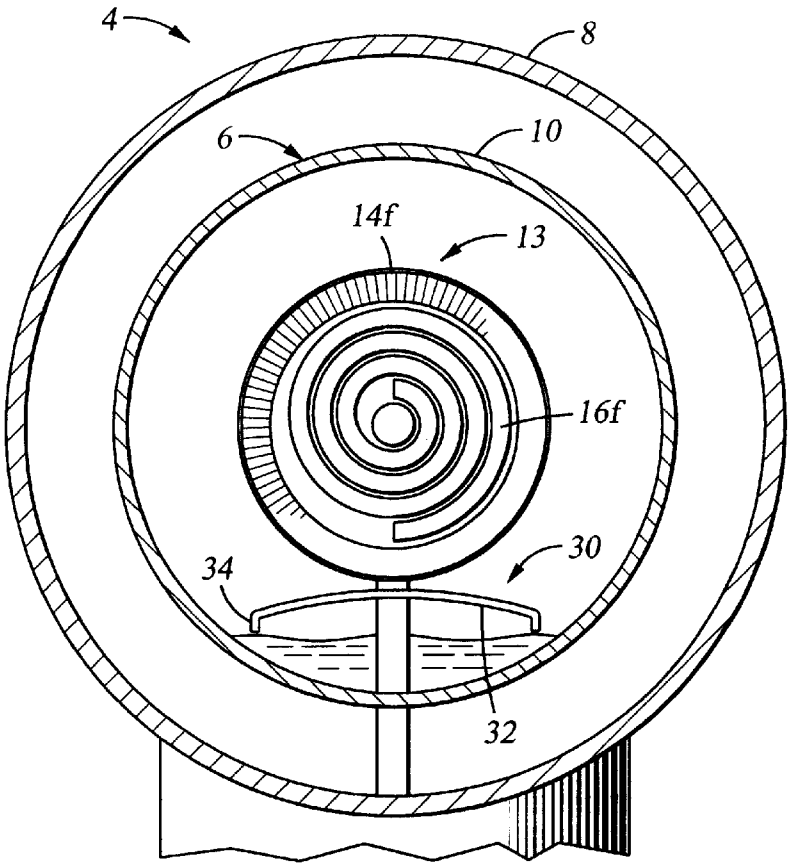
FIG. 6 is a schematic of an alternative embodiment of the shield in an outwardly disposed arrangement of the shield.

Another embodiment, shown in FIG. 6, could include an outwardly disposed shield 30 with the shield side(s) 34 outwardly disposed and having a shield bottom 32 inward of the sides. The shape could be a variety of shapes, includes rectangular, curved, round, and so forth. The vanes 9 and first stage array connectors 11 are not shown in the FIGS. 6 and 7 for clarity. The shape could also be a continuous curve, such that the sides and bottom merge. While this embodiment might not have the inwardly extending sides to partially envelope the array as shown in FIG. 3, this embodiment might have an advantage of allowing the liquefied gases to readily drain off the shield bottom 32 during regeneration.

Figure 8:
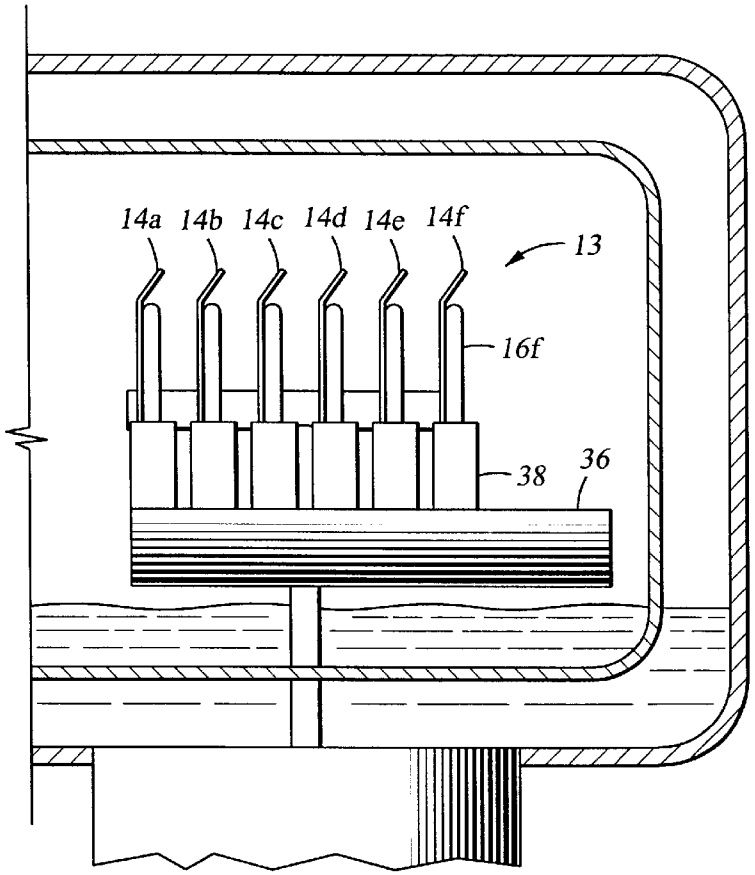
FIG. 8 is a schematic of a side view of FIG. 7.
Figure 7:
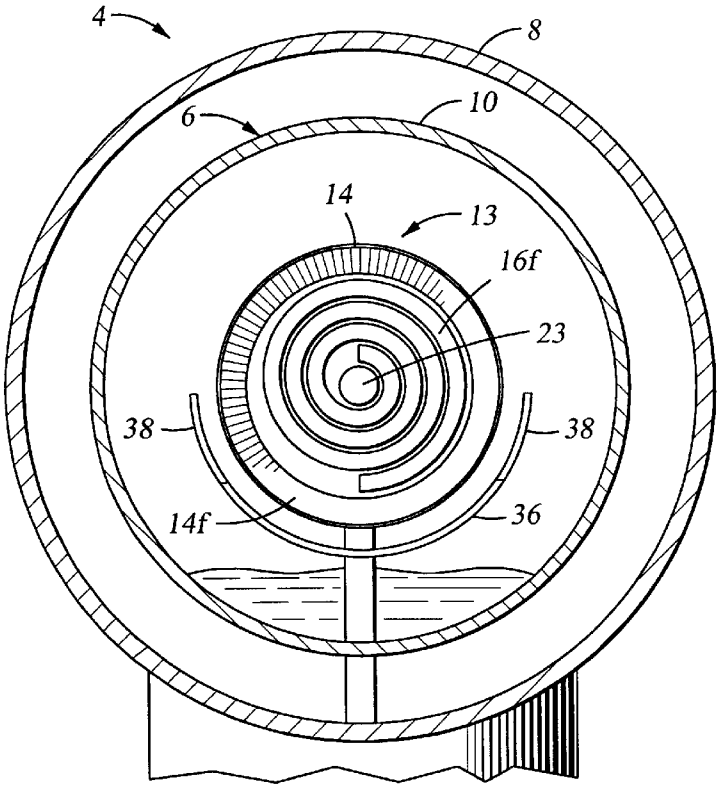
FIG. 7 is a schematic of the alternative embodiment of FIG. 4, having circumferentially extending flanges.

Another embodiment, shown in FIGS. 7 and 8, could include a shield 36 having the curved arrangement of FIG. 4 with some inwardly extending sides or flanges 38 to at least partially envelope the dislocatable material on the array and provide further shielding. While the flanges are shown with open spaces therebetween, the flanges could be substantially continuous around the perimeter of the shield or some other appropriate location. The flanges could also be form bands about the perimeter of the second stage array, although the pumping speed might be affected. The flanges could be positioned to allow molecules to affix to the array(s) and still at least partially protect the dislocatable material from the sudden flashing of the regeneration gases as described above.

While foregoing is directed to the preferred embodiment of the present invention, other and further embodiments of the invention may be devised without departing from the basic scope thereof, and the scope thereof is determined by the claims that follow.

What is claimed is:

1. A vacuum system having a regeneration shield, comprising:

a) a processing chamber;

b) at least one vacuum pump connected to the processing chamber comprising a first stage array forming an internal volume and a second stage array disposed substantially within the internal volume of the first stage array, at least a portion of the first stage array being disposed between an inlet of the pump and the second stage array;

c) a dislocatable material attached to the second stage array and disposed at least partially toward the first stage array; and d) a mechanical regeneration shield interposed between the second stage array and the first stage array, the shield adapted to shield the second stage array from gases produced during regeneration of the pump.

2. The system of claim 1, wherein the second stage array comprises one or more vertically inclined plates aligned substantially perpendicular to a direction of flow into the pump and wherein a centerline through the inclined plates is substantially horizontal.

3. The system of claim 1, wherein the dislocatable material comprises charcoal.

4. The system of claim 2, wherein the dislocatable material is disposed on a side of the second stage array distal from the processing chamber.

5. The system of claim 1, wherein the regeneration shield is disposed substantially parallel to a centerline through the second stage array.

6. The system of claim 1, wherein the second stage array comprises a plurality of plates that support the dislocatable material and wherein the regeneration shield is adapted to shield the dislocatable material on the plurality of plates.

7. The system of claim 1, wherein the shield comprises a substantially open top inwardly disposed radially toward the second stage array and disposed at least partially around a perimeter of the second stage array.

8. The system of claim 1, wherein the shield comprises a substantially open top outwardly disposed toward a perimeter of the pump in a radial direction away from the second stage array.

9. The system of claim 7, wherein the shield comprises inwardly extending flanges disposed radially at least partially around the second stage array, the flanges forming one or more open spaces therebetween.

10. The system of claim 8, wherein the shield comprises outwardly extending sides disposed toward a perimeter of the pump in a radial direction away from the second stage array.

11. The system of claim 1, wherein at least a portion of the shield is positioned at an elevation above a liquid level of regeneration gases collected in the pump during regeneration of the pump.

12. The system of claim 2, wherein at least a portion of the shield is positioned at an elevation above a liquid level of regeneration gases collected in the pump during regeneration of the pump.

13. The system of claim 1, wherein the chamber comprises a physical vapor deposition (PVD) chamber.

14. A method of protecting a processing chamber from a dislocatable material, comprising:

a) at least partially evacuating the processing chamber utilizing a vacuum pump having at least a first stage array and a second stage array disposed within an internal volume formed by the first stage array, the second stage array having dislocatable material attached thereto and disposed at least partially toward the first stage array;

b) flowing gases into the vacuum pump;

c) creating a restriction in the vacuum pump;

d) regenerating the vacuum pump; and e) shielding the dislocatable material on the second stage array from regeneration gases produced during regenerating the vacuum pump.

15. A method of protecting a processing chamber from a dislocatable material, comprising:

a) at least partially evacuating the processing chamber utilizing a vacuum pump having at least one array having dislocatable material;

b) flowing gases into the vacuum pump;

c) creating a restriction in the vacuum pump;

d) regenerating the vacuum pump;

g) shielding the dislocatable material on the array from regeneration gases produced during regenerating the vacuum pump; and f) reducing an amount of the dislocatable material from entering the chamber by utilizing the shield.

16. A method of protecting a processing chamber from a dislocatable material, comprising:

a) at least partially evacuating the processing chamber utilizing a vacuum pump having at least one array having dislocatable material;

b) flowing gases into the vacuum pump;

c) creating a restriction in the vacuum pump;

d) regenerating the vacuum pump;

e) shielding the dislocatable material on the array from regeneration gases produced during regenerating the vacuum pump; and f) allowing a portion of the dislocatable material to the dislocated from the array and collecting a dislocated portion of the dislocatable material in the shield.

17. The method of claim 14, wherein regenerating the vacuum pump comprises at least partially deicing the array.

18. The method of claim 17, further comprising orienting the shield to shed liquefied gases produced during regenerating the vacuum pump.

19. The method of claim 14, further comprising elevating at least a portion of the shield above a liquid level of regeneration gases collected in the pump during regeneration of the pump.

20. A cryogenic vacuum pump for a substrate processing system, the pump having a regeneration shields comprising:

a) a first stage array forming an internal volume and a second stage array disposed at least partially within the internal volume of the first stage array, at least a portion of the first stage array disposed between an inlet of the pump and the second stage array;

b) a dislocatable material attached to the second array and disposed at least partially toward the first array; and c) a mechanical regeneration shield interposed between the first stage array and the second stage array wherein the regeneration shield is adapted to shield the dislocatable material from regeneration gases produced during regeneration of the pump.

21. The system of claim 1, wherein an axis through the centerline of the second stage array is horizontally aligned.

* * * * *

UNITED STATES PATENT AND TRADEMARK OFFICE

CERTIFICATE OF CORRECTION

PATENT NO. : 6,122,921

DATED : September 26, 2000

INVENTOR(S) : Brezoczky et al.

It is certified that error appears in the above-identified patent and that said Letters Patent is hereby corrected as shown below:

In column 10, line 4, please replace " shields" with " shield" .

Signed and Sealed this

Eighth Day of May, 2001

*Attest:*

Nicholas P. Godici

NICHOLAS P. GODICI

*Attesting Officer*

*Acting Director of the United States Patent and Trademark Office*